US008876978B2

(12) United States Patent
Kawakami et al.

(10) Patent No.: US 8,876,978 B2
(45) Date of Patent: Nov. 4, 2014

(54) METHOD FOR REGENERATING GAS TURBINE BLADE AND GAS TURBINE BLADE REGENERATING APPARATUS

(75) Inventors: Tetsuji Kawakami, Hyogo-ken (JP); Ikumasa Koshiro, Nagasaki-ken (JP); Rumi Haruna, Hyogo-ken (JP); Yoshitaka Uemura, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 359 days.

(21) Appl. No.: 12/865,596

(22) PCT Filed: Feb. 14, 2008

(86) PCT No.: PCT/JP2008/052417

§ 371 (c)(1), (2), (4) Date: Jul. 30, 2010

(87) PCT Pub. No.: WO2009/101690

PCT Pub. Date: Aug. 20, 2009

(65) Prior Publication Data

US 2010/0326466 A1 Dec. 30, 2010

(51) Int. Cl.

| | |
|---|---|
| ***C23G 1/02*** | (2006.01) |
| ***C23G 1/14*** | (2006.01) |
| ***C23G 3/00*** | (2006.01) |
| ***B08B 3/08*** | (2006.01) |
| ***B08B 3/10*** | (2006.01) |
| ***C23F 1/44*** | (2006.01) |
| ***F01D 5/00*** | (2006.01) |

(52) U.S. Cl.

CPC . *F01D 5/005* (2013.01); *C23F 1/44* (2013.01); *F05D 2230/80* (2013.01)

USPC ..... 134/3; 134/2; 134/19; 134/28; 134/29; 134/30; 134/38; 134/41; 134/26

(58) Field of Classification Search

USPC ..... 134/2, 3, 19, 28, 29, 30, 38, 41, 84, 134/105, 113

See application file for complete search history.

(56) References Cited

U.S. PATENT DOCUMENTS 3,242,093 A * 3/1966 Compton ..... 510/245
3,546,084 A * 12/1970 Dohogne et al. ..... 205/710

(Continued)

FOREIGN PATENT DOCUMENTS

JP 64075894 A 3/1989

(Continued)

OTHER PUBLICATIONS

ISR for PCT/JP2008/052417, mailed May 13, 2008.
Office Action mailed Nov. 12, 2013 corresponds to Chinese patent application No. 200880125926.6.

*Primary Examiner* — Michael Kornakov
*Assistant Examiner* — Natasha Campbell
(74) *Attorney, Agent, or Firm* — Lowe Hauptman & Ham, LLP

(57) ABSTRACT

An object is to reduce changes in mechanical properties of a gas turbine blade base material during repair or regeneration of a gas turbine blade. For this purpose, a gas turbine blade after being operated is washed by being immersed into a strong alkaline washing solution, and the gas turbine blade after being washed with the strong alkaline washing solution is washed with water. The gas turbine blade after being washed with water is then washed by being immersed into a weak acid washing solution, and the gas turbine blade after being washed with the weak acid washing solution is subjected to heat treatment. The gas turbine blade after the heat treatment is then immersed into a strong acid washing solution, whereby the coating formed on the surface of the gas turbine blade is removed.

16 Claims, 4 Drawing Sheets

(56) References Cited

U.S. PATENT DOCUMENTS

| | | | | |
|---|---|---|---|---|
| 4,729,799 | A * | 3/1988 | Henricks et al. | 148/535 |
| 5,938,855 | A * | 8/1999 | Bowden, Jr. | 134/1 |
| 6,450,183 | B1 | 9/2002 | Cole et al. | |
| 6,454,870 | B1 | 9/2002 | Brooks | |
| 7,018,965 | B2 | 3/2006 | Yan et al. | |
| 2002/0103093 | A1 * | 8/2002 | LaGraff et al. | 510/185 |
| 2005/0035086 | A1 | 2/2005 | Chen et al. | |
| 2007/0125459 | A1 | 6/2007 | Gupta et al. | |

FOREIGN PATENT DOCUMENTS

| | | | |
|---|---|---|---|
| JP | 200164736 | A | 3/2001 |
| JP | 200334887 | A | 2/2003 |
| JP | 2003193276 | A | 7/2003 |
| JP | 2005061409 | A | 3/2005 |
| JP | 2007504323 | A | 3/2007 |
| JP | 3923311 | B2 | 5/2007 |
| JP | 2007176780 | A | 7/2007 |
| JP | 2007186786 | A | 7/2007 |

* cited by examiner

METHOD FOR REGENERATING GAS TURBINE BLADE AND GAS TURBINE BLADE REGENERATING APPARATUS

RELATED APPLICATIONS

The present application is national phase of and claims priority to PCT/JP2008/052417 filed Feb. 14, 2008, the disclosure of which is hereby incorporated by reference herein in its entirety.

TECHNICAL FIELD

The present invention relates to a method for regenerating a gas turbine blade and a gas turbine blade regenerating apparatus.

BACKGROUND ART

Components of a gas turbine engine such as turbine nozzle segments are repaired and recoated by being washed with an alkaline washing solution, and then washed with an acid washing solution. Patent document 1 discloses a method for washing turbine nozzle segments with an alkaline solution containing sodium hydroxide and sodium permanganate, and then washing the washed turbine nozzle segments with a nitric acid aqueous solution of from 60% by volume to 80% by volume, to remove oxide from the turbine nozzle segments after being operated.

[Patent document 1] Japanese Patent Application Laid-open No. 2007-186786 (paragraphs 0010 and 0011)

DISCLOSURE OF INVENTION

Problem to be Solved by the Invention

To protect the surface of a gas turbine blade from high-temperature combustion gas, the surface of the gas turbine blade is coated, for example, with a Cobalt-Nickel-Chromium-Aluminum-Yttrium (CoNiCrAlY) alloy, thereby forming a ceramic refractory layer on the surface. The coating and the ceramic refractory layer on the gas turbine blade that has been used for a long period of time are to be regenerated or repaired. Before regeneration or repair of the gas turbine blade, the coating is removed by carrying out acid washing.

Residual stress may occur in the gas turbine blade due to the strain on the gas turbine blade during the operation performed by the gas turbine. If the acid washing is carried out in this situation, stress corrosion cracking may occur in the gas turbine blade. To prevent the stress corrosion cracking from occurring in the gas turbine blade, the residual stress in the blade needs to be removed by heat treatment before carrying out the acid washing.

After the gas turbine has been operated for a long period of time, scales such as corrosive oxide are deposited on the gas turbine blade. At the inner wall of a cooling medium passage formed inside the gas turbine blade, scales including $Fe_2O_3$, $Na_2SO_4$, $ZnSO_4$, compounds such as iron alum, iron sulfate hydroxide ($(K, Na)Fe_3(SO_4)_2(OH)_6$) and iron sulfate hydrate ($(Na, K)_2Fe(SO_4)_2.4H_2O$)), $FeSO_4$, NiO, $Co_2O_3$, $Cr_2O_3$, $Al_2O_3$, CaO, and $SiO_2$ are deposited. This is because, while the gas turbine is operating, even if scales in air are prevented from being deposited on the gas turbine blade as much as possible by removing fine particles contained in the air used for combustion with a filter, scales in fuel of the gas turbine and the like are deposited on the gas turbine blade. For example, if scales are deposited on the inner wall surface of the cooling medium passage inside the gas turbine blade, the scales are fixed to the inner wall surface of the cooling medium passage due to heat generated by combustion and transferred from the outer surface of the gas turbine blade to the inner wall surface of the cooling medium passage.

If heat treatment for reducing the residual stress in the gas turbine blade is performed while the scales remain on the inner wall surface of the cooling medium passage, carbides in the grain boundaries of a gas turbine blade base material disappear from the surface to the deep region of the gas turbine blade. Accordingly, the mechanical properties of the gas turbine blade base material may be changed. The present invention has been made in view of the above circumstances and an object of the present invention is to reduce changes in mechanical properties of the gas turbine blade base material during repair or regeneration of the gas turbine blade.

Means for Solving Problem

According to an aspect of the present invention, a method for regenerating a gas turbine blade includes: a step of strong alkaline washing at which a gas turbine blade after being operated is washed by being immersed into a strong alkaline washing solution; a step of water washing at which the gas turbine blade after being washed with the strong alkaline washing solution is washed with water; a step of weak acid washing at which the gas turbine blade after being washed with the water is washed by being immersed into a weak acid washing solution; a step of heat treatment at which the gas turbine blade after being washed with the weak acid washing solution is subjected to heat treatment; and a step of removing coating at which at least a part of coating formed on a surface of the gas turbine blade is removed by immersing the gas turbine blade after the heat treatment into a strong acid washing solution. Preferably, the method for regenerating the gas turbine blade according to the present invention includes a step of strong alkaline washing at which a gas turbine blade after being operated is washed by being immersed into a strong alkaline washing solution, or preferably, into a strong alkaline washing solution containing an oxidizing agent, a step of water washing at which the gas turbine blade after being washed with the strong alkaline washing solution is washed with water, a step of weak acid washing at which the gas turbine blade after being washed with water is washed by being immersed into a weak acid washing solution, a step of post-weak-acid-washing water washing at which the gas turbine blade after being washed with the weak acid washing solution is washed with water, a step of heat treatment at which the gas turbine blade after being washed with water at the step of post-weak-acid-washing water washing is subjected to heat treatment, and a step of removing coating at which at least a part of coating formed on a surface of the gas turbine blade is removed by immersing the gas turbine blade after the heat treatment into a strong acid washing solution.

In this method for regenerating the gas turbine blade, scales deposited on an inner wall surface of a cooling medium passage formed inside the gas turbine blade can be removed by washing before carrying out heat treatment. Accordingly, changes in mechanical properties of a gas turbine blade base material resulting from the scales can be reduced during repair or regeneration of the gas turbine blade. Potential hydrogen of the strong alkaline solution is equal to or more than 10. Potential hydrogen of the weak acid solution is in a range from equal to or more than 3 to less than 7. Potential hydrogen of the strong acid solution is less than 3. It is preferable that the strong alkaline washing solution contains an oxidizing agent.

As an exemplary aspect of the present invention, in the method for regenerating the gas turbine blade, it is preferable that the strong alkaline washing solution is an aqueous alkali metal hydroxide solution containing an alkali metal salt of permanganate. In this manner, because the composition of the strong alkaline washing solution is simple, it is possible to repeatedly use the strong alkaline washing solution while controlling the concentration.

As an exemplary aspect of the present invention, in the method for regenerating the gas turbine blade, it is preferable that the aqueous alkali metal hydroxide solution is an aqueous sodium hydroxide solution containing potassium permanganate. In this manner, because the composition of the strong alkaline washing solution is simple, it is possible to repeatedly use the strong alkaline washing solution while controlling the concentration.

As an exemplary aspect of the present invention, in the method for regenerating the gas turbine blade, at the step of strong alkaline washing, it is preferable to use the aqueous alkali metal hydroxide solution having a self-potential equal to or more than 200 mVvsAg/AgCl_sat.KCl, in other words, equal to or more than 400 mVSHE. In this manner, it is possible to easily inspect the detergency of the strong alkaline washing solution in a short period of time. Accordingly, it is possible to perform the washing with the strong alkaline washing solution, with the strong alkaline washing solution whose detergency satisfies the standard without fail.

As an exemplary aspect of the present invention, in the method for regenerating the gas turbine blade, at the step of strong alkaline washing, it is preferable to wash the gas turbine blade, by keeping the temperature of the strong alkaline washing solution at equal to or more than 70 degrees centigrade and equal to or less than 95 degrees centigrade, or preferably, at equal to or more than 72 degrees centigrade and equal to or less than 95 degrees centigrade. In this manner, it is possible to prevent excessive evaporation of the strong alkaline washing solution, thereby enabling the gas turbine blade to be washed in a short period of time.

As an exemplary aspect of the present invention, in the method for regenerating the gas turbine blade, it is preferable that the weak acid washing solution is an aqueous weak acid solution of citric acid and citric acid diammonium salt. In this manner, in the components of the scales deposited on the gas turbine blade, it is possible to easily dissolve and remove iron oxide in particular, and at the next step of heat treatment, the rotor blade base material is less likely to deteriorate, compared with when the heat treatment is performed while the iron oxide is still being deposited.

As an exemplary aspect of the present invention, in the method for regenerating the gas turbine blade, it is preferable that the aqueous weak acid solution used at the step of weak acid washing has an absorbance equal to or more than 0 and equal to or less than 1.5, and preferably, equal to or more than 0 and equal to or less than 1.2 at a wavelength of 400 nanometers. In this manner, it is possible to easily inspect the detergency in a short period of time, compared with when the detergency is inspected by analyzing the concentrations of citric acid and ammonium. Accordingly, it is possible to perform the weak acid washing with the weak acid washing solution with the detergency satisfying the standard without fail.

As an exemplary aspect of the present invention, in the method for regenerating the gas turbine blade, at the step of weak acid washing, it is preferable to wash the gas turbine blade by keeping the temperature of the weak acid washing solution at equal to or more than 80 degrees centigrade and equal to or less than 99 degrees centigrade, and preferably, at equal to or more than 80 degrees centigrade and equal to or less than 95 degrees centigrade, and more preferably, at equal to or more than 90 degrees centigrade and equal to or less than 95 degrees centigrade. In this manner, it is possible to prevent excessive evaporation of the weak acid washing solution, thereby enabling the gas turbine blade to be washed in a short period of time.

As an exemplary aspect of the present invention, in the method for regenerating the gas turbine blade, it is preferable that the strong acid washing solution is hydrochloric acid. In this manner, it is possible to remove an oxidation resistant coating such as a CoNiCrAlY alloy formed on the surface of the gas turbine blade without fail.

To solve the problems described above and to achieve the object, a gas turbine blade regenerating apparatus according to the present invention includes a supporting unit that supports a gas turbine blade after being operated, a strong alkaline washing basin that stores therein a strong alkaline washing solution for washing the gas turbine blade and includes a strong alkaline washing solution heating unit heating the strong alkaline washing solution, a water-washing basin in which the gas turbine blade being washed in the strong alkaline solution washing basin is washed with water, a weak acid washing basin that stores therein a weak acid washing solution for washing the gas turbine blade being washed in the water-washing basin with water and includes a weak acid washing solution heating unit heating the weak acid washing solution, a heat treatment device that includes a heating unit and performs heat treatment on the gas turbine blade after being washed with the weak acid washing solution, and a coating removal basin that stores therein a strong acid washing solution for removing at least a part of coating on a surface of the gas turbine blade after the heat treatment by the heat treatment device and includes a strong acid washing solution heating unit heating the strong acid washing solution. Preferably, the gas turbine blade regenerating apparatus according to the present invention further includes a post-weak-acid-washing water-washing basin in which the gas turbine blade after being washed with the weak acid washing solution and before being subjected to heat treatment by the heat treatment device is washed with water.

This gas turbine blade regenerating apparatus can remove scales deposited on the inner wall surface of the cooling medium passage formed inside the gas turbine blade, by washing before carrying out heat treatment. Accordingly, changes in mechanical properties of a gas turbine blade base material resulting from the scales can be reduced during repair or regeneration of the gas turbine blade. It is preferable that the strong alkaline washing solution contains an oxidizing agent.

As an exemplary aspect of the present invention, in the gas turbine blade regenerating apparatus, it is preferable that the strong alkaline washing basin further includes a strong alkaline washing solution temperature controlling unit that keeps a temperature of the strong alkaline washing solution at a predetermined temperature. In this manner, it is possible to keep the washing conditions of the strong alkaline washing solution constant, whereby scales are removed without fail.

As an exemplary aspect of the present invention, in the gas turbine blade regenerating apparatus, it is preferable that the weak acid washing basin further includes a weak acid washing solution temperature controlling unit that keeps a temperature of the weak acid washing solution at a predetermined temperature. In this manner, it is possible to keep the washing conditions of the weak acid washing solution constant, whereby scales are removed without fail.

Effect of the Invention

With the present invention, it is possible to reduce changes in mechanical properties of a gas turbine blade base material during repair or regeneration of a gas turbine blade.

EXPLANATIONS OF LETTERS OR NUMERALS

Figure 1:
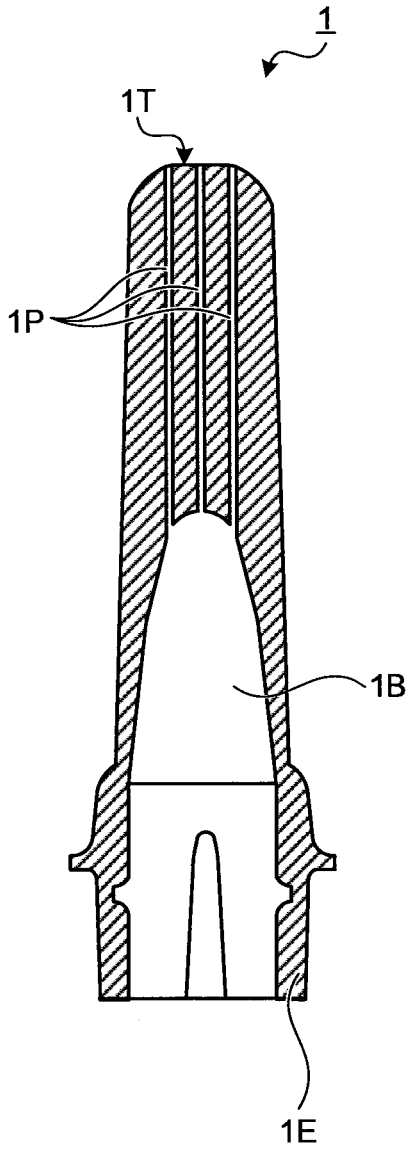
FIG. 1 is a schematic sectional view of a gas turbine rotor blade.

1 gas turbine rotor blade
1B cooling medium passage branching unit
1E fitting unit
1P inner cooling medium passage
1T rotor blade tip
2 supporting unit
2*a* moving unit
3 strong alkaline washing basin
11 post-strong-alkaline-washing water-washing basin
12 post-strong-alkaline-washing high-pressure water washing device
13 post-strong-alkaline-washing ultrasonic wave washing basin
16 weak acid washing basin
24 post-weak-acid-washing water-washing basin
25 post-weak-acid-washing high-pressure water washing device
26 post-weak-acid-washing ultrasonic wave washing basin
29 heat treatment device
37 coating removal basin
48 neutralization basin
49 post-coating-removal water-washing basin
50 hot water washing basin
100 gas turbine blade regenerating apparatus (regenerating apparatus)

BEST MODE(S) FOR CARRYING OUT THE INVENTION

The present invention will now be described in detail with reference to the drawings. The present invention is not limited to the best modes (hereinafter, embodiments) for carrying out the invention. Constituent elements according to the embodiments below include elements that can be easily thought of by a person skilled in the art, elements being substantially the same as those elements, and elements that fall within a so-called range of equivalents.

In the present embodiment, a gas turbine blade after operation is washed by sequentially being: immersed into a strong alkaline washing solution, or preferably, into a strong alkaline washing solution containing an oxidizing agent; washed with water; washed by being immersed into a weak acid washing solution; and subjected to heat treatment. The feature of the present embodiment is that the gas turbine blade after the heat treatment is immersed into a strong acid washing solution, whereby the coating formed on the surface of the gas turbine blade is removed. A gas turbine blade regenerating apparatus according to the present embodiment will now be described.

[Gas Turbine Blade Regenerating Apparatus]

Figure 2:
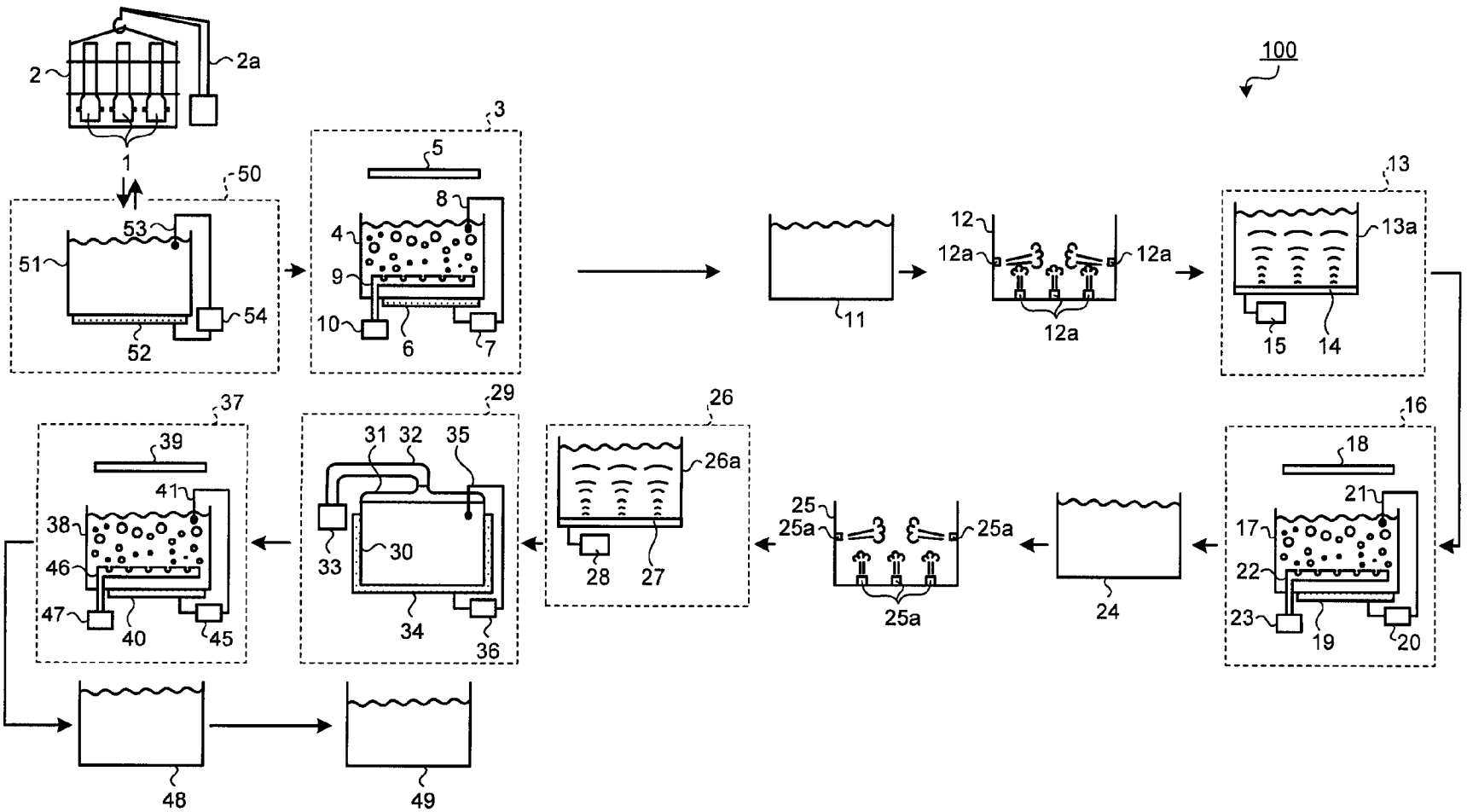
FIG. 2 is a schematic of a gas turbine blade regenerating apparatus according to a present embodiment.

FIG. 1 is a schematic sectional view of a gas turbine rotor blade. FIG. 2 is a schematic of a gas turbine blade regenerating apparatus according to the present embodiment. An object to be regenerated by a gas turbine blade regenerating apparatus (hereinafter, referred to as regenerating apparatus) 100 according to the present embodiment is a gas turbine blade. In the present embodiment, an object to be regenerated is a gas turbine rotor blade 1 illustrated in FIG. 1. However, an object to be regenerated by the regenerating apparatus 100 is not limited to the gas turbine rotor blade 1, but may also be a gas turbine nozzle. The stage of the gas turbine rotor blade 1 or the gas turbine nozzle to be regenerated is not limited (the same applies in the following).

The regenerating apparatus 100 includes a supporting unit 2, a moving unit 2*a*, a hot water washing basin 50, a strong alkaline washing basin 3, a post-strong-alkaline-washing water-washing basin 11, a post-strong-alkaline-washing high-pressure water washing device 12, a post-strong-alkaline-washing ultrasonic wave washing basin 13, a weak acid washing basin 16, a post-weak-acid-washing water-washing basin 24, a post-weak-acid-washing high-pressure water washing device 25, a post-weak-acid-washing ultrasonic wave washing basin 26, a heat treatment device 29, a coating removal basin 37, a neutralization basin 48, and a post-coating-removal water-washing basin 49.

The supporting unit 2 supports the gas turbine rotor blade 1 to be washed. The supporting unit 2 can support the gas turbine rotor blade 1 with the longitudinal direction of the gas turbine rotor blade 1 being substantially parallel to the vertical direction, the side of a fitting unit 1E being the lower side, and the side of a rotor blade tip 1T being the upper side. A cooling medium passage (hereinafter, inner cooling medium passage) 1P formed inside the gas turbine rotor blade 1, and through which cooling medium such as air and steam passes, is formed narrower than the fitting unit 1E and a cooling medium passage branching unit 1B. Accordingly, by supporting the gas turbine rotor blade 1 so that the side of the rotor blade tip 1T is on the upper side, it is possible to prevent solids such as oxides separated from the inner cooling medium passage 1P and the cooling medium passage branching unit 1B during the washing process, from blocking the inner cooling medium passage 1P.

In the regenerating apparatus 100 and in a method for regenerating a gas turbine blade according to the present embodiment, a strong alkaline washing solution and a strong acid washing solution are used. Accordingly, the supporting unit 2 is made of a material capable of resisting corrosion during the washing process. The supporting unit 2, for example, is made of a metal material coated with fluorine resin. The supporting unit 2 is immersed into a washing solution, pulled out from the washing solution, and moved between the washing basins, by the moving unit 2*a*. A crane, a jack, and the like, is used as the moving unit 2*a*.

The hot water washing basin 50 includes a hot water washing container 51, a heating unit 52, a liquid temperature detecting unit 53, and a liquid temperature controlling unit 54. Hot water is stored in the hot water washing container 51, and the gas turbine rotor blade 1 supported by the supporting unit 2 is immersed into the hot water in the hot water washing container 51 by the moving unit 2*a*. In the present embodiment, the temperature of the hot water is kept at a constant temperature set in advance by the heating unit 52, the liquid temperature detecting unit 53, and the liquid temperature controlling unit 54. Because the regenerating apparatus 100 includes the hot water washing basin 50, in the scales deposited on the gas turbine rotor blade 1 during the operation performed by the gas turbine, oil and water-soluble scales can be removed to a certain degree. As a result, the strong alkaline washing solution can more easily penetrate through the scales, thereby improving the effects of alkaline washing.

The strong alkaline washing basin 3 is a basin for washing the gas turbine rotor blade 1 after being washed with the hot water, with a strong alkaline washing solution, or preferably with a strong alkaline washing solution containing an oxidizing agent. Because the regenerating apparatus 100 includes the strong alkaline washing basin 3, scale components soluble in the strong alkaline washing solution are removed, thereby more easily separating the scales from the gas turbine rotor blade 1. Because the separation and removal of scales are accelerated, it is possible to prevent carbides in the grain boundaries of a base material of the gas turbine rotor blade 1 (gas turbine blade base material) from disappearing from the outer surface of the gas turbine rotor blade 1, and from the inner wall surface to the deep region of the inner cooling medium passage 1P and the cooling medium passage branching unit 1B. As a result, it is possible to prevent changes in mechanical properties of the gas turbine rotor blade 1 (in particular, changes in mechanical properties at a high temperature).

Even a place where a polishing unit such as a brush cannot reach, like the cooling medium passage branching unit 1B and the inner cooling medium passage 1P of the gas turbine rotor blade 1, can be washed. It is preferable that the strong alkaline washing basin 3 includes an agitating unit that agitates the strong alkaline washing solution. If the strong alkaline washing basin 3 includes the agitating unit, the strong alkaline washing solution can be agitated to keep the concentration of the strong alkaline washing solution uniform. Accordingly, it is possible to prevent washing irregularities of the gas turbine rotor blade 1 from occurring.

The strong alkaline washing basin 3 of the regenerating apparatus 100 includes a strong alkaline washing container 4, a bubble introduction tube 9, an air supplying device 10, a strong alkaline washing solution heating unit 6, a strong alkaline washing solution temperature detecting unit 8, a strong alkaline washing solution temperature controlling unit 7, and a strong alkaline washing container lid 5. The gas turbine rotor blade 1 after being washed with the hot water is supported by the supporting unit 2, and moved to the strong alkaline washing basin 3 from the hot water washing basin 50 and immersed into a strong alkaline washing solution stored in the strong alkaline solution washing container 4 by the moving unit 2*a*. The strong alkaline washing container 4 is then covered with a strong alkaline solution washing container lid 5. By using the strong alkaline solution washing container lid 5, it is possible to reduce evaporation of the strong alkaline washing solution.

During the washing, the air supplying device 10 supplies gas (such as air) to the bubble introduction tube 9 disposed directly above the bottom surface of the strong alkaline washing container 4. Bubbles introduced into the strong alkaline washing container 4 from openings provided at the bubble introduction tube 9 move upward, while colliding with the gas turbine rotor blade 1. Because the strong alkaline washing basin 3 includes the air supplying device 10 and the bubble introduction tube 9, the strong alkaline washing solution in the strong alkaline washing container 4 is agitated, thereby preventing washing irregularities of the gas turbine rotor blade 1. The bubbles also assist the washing with the strong alkaline washing solution. It is also possible to reduce the amount of strong alkaline washing solution to be used, thereby reducing the amount of washing liquid waste. The temperature of the strong alkaline washing solution is controlled by the strong alkaline washing solution heating unit 6, the strong alkaline washing solution temperature detecting unit 8, and the strong alkaline washing solution temperature controlling unit 7.

The post-strong-alkaline-washing water-washing basin 11 is a basin for washing the gas turbine rotor blade 1 after being washed with the strong alkaline washing solution, with water. Water is stored in the post-strong-alkaline-washing water-washing basin 11, and the washing is performed by immersing the gas turbine rotor blade 1 into the water. Because the regenerating apparatus 100 includes the post-strong-alkaline-washing water-washing basin 11, it is possible to remove the strong alkaline washing solution deposited on the gas turbine rotor blade 1. Further, the scales are rapidly cooled and become more easily removed from the gas turbine rotor blade 1. It is preferable that the post-strong-alkaline-washing water-washing basin 11 includes an agitating unit that agitates the water in the post-strong-alkaline-washing water-washing basin 11. In this manner, the water collides with the surface of the gas turbine rotor blade 1, thereby effectively removing the scales.

The post-strong-alkaline-washing high-pressure water washing device 12 is a device that washes the gas turbine rotor blade 1 after being washed in the post-strong-alkaline-washing water-washing basin 11 with high-pressure running water. Because the regenerating apparatus 100 includes the post-strong-alkaline-washing high-pressure water washing device 12, it is possible to more easily remove the strong alkaline washing solution and the scales being deposited on the gas turbine rotor blade 1. The post-strong-alkaline-washing high-pressure water washing device 12 includes a high-pressure running water nozzle 12*a*. The inner walls of the inner cooling medium passage 1P and the cooling medium passage branching unit 1B, and the outer surface of the gas turbine rotor blade 1 are washed with high-pressure water ejected from the high-pressure running water nozzle 12*a*. It is also possible to provide a high-pressure running water nozzle in the post-strong-alkaline-washing water-washing basin 11, and use the post-strong-alkaline-washing water-washing basin 11 also as the post-strong-alkaline-washing high-pressure water washing device.

The post-strong-alkaline-washing ultrasonic wave washing basin 13, is a basin for washing the gas turbine rotor blade 1 after being washed by the post-strong-alkaline-washing high-pressure water washing device 12, with ultrasonic waves. Because the regenerating apparatus 100 includes the post-strong-alkaline-washing ultrasonic wave washing basin 13, it is possible to more easily remove the strong alkaline washing solution and the scales deposited on the gas turbine rotor blade 1. The post-strong-alkaline-washing ultrasonic wave washing basin 13 includes a post-strong-alkaline-washing ultrasonic wave washing container 13*a*, an oscillator 15, and a resonator 14.

The gas turbine rotor blade 1 is immersed into the water stored in the post-strong-alkaline-washing ultrasonic wave washing container 13*a*, and the gas turbine rotor blade 1 is washed by ultrasonic waves generated by vibrating the resonator 14 with the oscillator 15. It is also possible to connect the oscillator 15 and the resonator 14 to the post-strong-alkaline-washing water-washing basin 11, and use the post-strong-alkaline-washing water-washing basin 11 also as the post-strong-alkaline-washing ultrasonic wave washing basin.

The weak acid washing basin 16 is a basin for washing the gas turbine rotor blade 1 after being washed with water after the strong alkaline washing, with a weak acid washing solution. Because the regenerating apparatus 100 includes the weak acid washing basin 16, it is possible to remove the scale components soluble in the weak acid washing solution from the gas turbine rotor blade 1. As a result, during heat treatment performed by the heat treatment device 29, which will be described later, it is possible to prevent carbides in the grain boundaries of the gas turbine blade base material from disappearing from the outer surface of the gas turbine rotor blade 1, and from the inner wall surface to the deep region of the inner cooling medium passage 1P and the cooling medium passage branching unit 1B. It is also possible to prevent changes in mechanical properties of the gas turbine rotor blade 1 (in particular, changes in mechanical properties at a high temperature). Even a place where a polishing unit such as a brush cannot reach, like the inner cooling medium passage 1P of the gas turbine rotor blade 1 can also be washed. It is preferable that the weak acid washing basin 16 includes an agitating unit that agitates the weak acid washing solution. If the weak acid washing basin 16 includes the agitating unit, the weak acid washing solution can be agitated to keep the concentration of the weak acid washing solution uniform. Accordingly, it is possible to prevent washing irregularities of the gas turbine rotor blade 1.

The weak acid washing basin 16 includes a weak acid washing container 17, a bubble introduction tube 22, an air supplying device 23, a weak acid washing solution heating unit 19, a weak acid washing solution temperature detecting unit 21, a weak acid washing solution temperature controlling unit 20, and a weak acid washing container lid 18. The gas turbine rotor blade 1 is immersed into the weak acid washing solution stored in the weak acid washing container 17, by the moving unit 2*a*. The weak acid washing container 17 is then covered with the weak acid washing container lid 18. By using the weak acid washing container lid 18, it is possible to prevent evaporation of the weak acid washing solution.

During the washing, the air supplying device 23 supplies gas, such as air, to the bubble introduction tube 22 disposed directly above the bottom surface of the weak acid washing container 17. Bubbles supplied from openings provided at the bubble introduction tube 22 move upward, while colliding with the gas turbine rotor blade 1. Because the weak acid washing basin 16 includes the air supplying device 23 and the bubble introduction tube 22, the weak acid washing solution in the weak acid washing container 17 is agitated, thereby assisting the washing with the weak acid washing solution. It is also possible to reduce the amount of weak acid washing solution used for washing the gas turbine rotor blade 1, thereby reducing the amount of washing liquid waste. The temperature of the weak acid washing solution is controlled by the weak acid washing solution heating unit 19, the weak acid washing solution temperature detecting unit 21, and the weak acid washing solution temperature controlling unit 20.

The post-weak-acid-washing water-washing basin 24, is a basin for washing the gas turbine rotor blade 1 after being washed with the weak acid washing solution, with water. Water is stored in the post-weak-acid-washing water-washing basin 24, and the gas turbine rotor blade 1 is washed by being immersed into the water. Because the regenerating apparatus 100 includes the post-weak-acid-washing water-washing basin 24, it is possible to wash and remove the weak acid washing solution deposited on the gas turbine rotor blade 1. It is preferable that the post-weak-acid-washing water-washing basin 24 includes an agitating unit that agitates the water in the post-weak-acid-washing water-washing basin 24. In this manner, the water collides with the surface of the gas turbine rotor blade 1, thereby improving the washing effect of the weak acid washing and reducing the washing time.

The post-weak-acid-washing high-pressure water washing device 25, is a device that washes the gas turbine rotor blade 1 after being washed in the post-weak-acid-washing water-washing basin 24 with high-pressure running water. Because the regenerating apparatus 100 includes the post-weak-acid-washing high-pressure water washing device 25, it is possible to easily remove the weak acid washing solution and the scales deposited on the gas turbine rotor blade 1. The post-weak-acid-washing high-pressure water washing device 25 includes a high-pressure running water nozzle 25*a*. The inner wall surface and the outer surface of the cooling medium passage branching unit 1B and the like of the gas turbine rotor blade 1 are washed with high-pressure water ejected from the high-pressure running water nozzle 25*a*. It is also possible to provide a high-pressure running water nozzle in the post-weak-acid-washing water-washing basin 24, and use the post-weak-acid-washing water-washing basin 24 also as the post-weak-acid-washing high-pressure water washing device.

The post-weak-acid-washing ultrasonic wave washing basin 26, is a basin for washing the gas turbine rotor blade 1 after being washed by the post-weak-acid-washing high-pressure water washing device 25, with ultrasonic waves. Because the regenerating apparatus 100 includes the post-weak-acid-washing ultrasonic wave washing basin 26, the weak acid washing solution deposited on the gas turbine rotor blade 1 is removed, whereby scales are removed more easily. The post-weak-acid-washing ultrasonic wave washing basin 26 includes a post-weak-acid-washing ultrasonic wave washing container 26*a*, an oscillator 28, and a resonator 27. The gas turbine rotor blade 1 is immersed into the water stored in the post-weak-acid-washing ultrasonic wave washing container 26*a*, and the gas turbine rotor blade 1 is washed by ultrasonic waves generated by vibrating the resonator 27. It is also possible to connect the oscillator 28 and the resonator 27 to the post-weak-acid-washing water-washing basin 24, and use the post-weak-acid-washing water-washing basin 24 also as the post-weak-acid-washing ultrasonic wave washing basin.

The heat treatment device 29 is a device that performs heat treatment on the gas turbine rotor blade 1 after being washed with the weak acid washing solution, and then preferably being washed with water. The heat treatment is performed on the gas turbine rotor blade 1, after the gas turbine rotor blade 1 is washed in the strong alkaline washing basin 3, washed with water, washed in the weak acid washing basin 16, and then preferably washed with water. Because the regenerating apparatus 100 includes the heat treatment device 29, it is possible to remove the residual stress from the gas turbine rotor blade 1 after the operation performed by the gas turbine. Accordingly, in the removal of coating from the gas turbine rotor blade 1 using a strong acid washing solution, which will be described later, it is possible to prevent stress corrosion cracking from occurring in the gas turbine rotor blade 1. The structure of the gas turbine blade base material can also be recovered.

In the present embodiment, the heat treatment device 29 is a vacuum heat treatment device. The heat treatment device 29 includes a heat treatment container 30, a heat treatment container lid 31 for sealing the heat treatment container 30, an exhaust tube 32 connected to the heat treatment container lid 31 or the heat treatment container 30, an exhaust unit 33 for exhausting air in the heat treatment container 30 through the exhaust tube 32, a heat treatment container heating unit 34 that heats the inside of the heat treatment container 30, a heat treatment container inner temperature detecting unit 35, and a heat treatment container inner temperature controlling unit 36. The gas turbine 1 is stored in the heat treatment container 30, and the heat treatment container 30 is sealed by being covered with the heat treatment container lid 31. Air inside the heat treatment container 30 passes through the exhaust tube 32 connected to the heat treatment container 30 or the heat treatment container lid 31, and is taken out by the exhaust unit 33.

Because the heat treatment device 29 includes the exhaust unit 33, it is possible to prevent the gas turbine blade base material from reacting with components in the air, for example, oxygen, while performing heat treatment. The space surrounded by the heat treatment container 30 and the heat treatment container lid 31, in other words, the inside of the heat treatment container 30 is heated to a predetermined temperature by the heat treatment container heating unit 34, the heat treatment container inner temperature detecting unit 35, and the heat treatment container inner temperature controlling unit 36. Accordingly, the heat treatment is performed on the gas turbine rotor blade 1 stored in the heat treatment container 30.

The coating removal basin 37 is a basin for removing at least a part of the coating on the surface of the gas turbine rotor blade 1, with the strong acid washing solution. Because the regenerating apparatus 100 includes the coating removal basin 37, at least a part of the coating on the surface of the gas turbine rotor blade 1 can be removed. As a result, a new coating can be applied on the gas turbine rotor blade 1. It is preferable that the coating removal basin 37 includes an agitating unit that agitates the strong acid washing solution. In this manner, the strong acid washing solution can be agitated to keep the concentration uniform. Accordingly, it is possible to prevent irregularities of coating removal of the gas turbine rotor blade 1.

The coating removal basin 37 of the regenerating apparatus 100 includes a coating removal container 38, a bubble introduction tube 46, an air supplying device 47, a strong acid washing solution heating unit 40, a strong acid washing solution temperature detecting unit 41, a strong acid washing solution temperature controlling unit 45, and a coating removal container lid 39. The gas turbine rotor blade 1 after the heat treatment is supported by the supporting unit 2, and immersed into the strong acid washing solution stored in the coating removal container 38.

The coating removal container 38 is then covered with the coating removal container lid 39. By using the coating removal container lid 39, it is possible to prevent evaporation of the strong acid washing solution as much as possible.

During the washing, the air supplying device 27 supplies gas, such as air, to the bubble introduction tube 46 disposed directly above the bottom surface of the coating removal container 38. Bubbles introduced from openings provided at the bubble introduction tube 46 move upward, while colliding with the gas turbine rotor blade 1. Because the coating removal basin 37 includes the air supplying device 47 and the bubble introduction tube 46, it is possible to agitate the strong acid washing solution in the coating removal container 38. The bubbles also assist the removal of coating with the strong acid washing solution, thereby reducing the time required for removing the coating. It is also possible to reduce the amount of strong acid washing solution to be used, thereby reducing the amount of washing liquid waste. The temperature of the strong acid washing solution is controlled by the strong acid washing solution heating unit 40, the strong acid washing solution temperature detecting unit 41, and the strong acid washing solution temperature controlling unit 45. In this manner, it is possible to keep the washing conditions with the strong acid washing solution constant, whereby the coating is removed without fail.

The neutralization basin 48 is a basin for neutralizing the acid components of the strong acid washing solution remaining on the gas turbine rotor blade 1, after at least a part of the coating of the gas turbine rotor blade 1 is removed. Because the regenerating apparatus 100 includes the neutralization basin 48, it is possible to neutralize the acid components remained on the gas turbine rotor blade 1. It is preferable that the neutralization basin 48 includes an agitating unit that agitates a neutralization solution in the basin. In this manner, it is possible to quickly neutralize the acid components remaining on the gas turbine rotor blade 1.

The post-coating-removal water-washing basin 49 is a basin for washing the gas turbine rotor blade 1 whose acid component is neutralized in the neutralization basin 48, with water. Because the regenerating apparatus 100 includes the post-coating-removal water-washing basin 49, it is possible to remove salts remaining on the gas turbine rotor blade 1 generated during neutralization. It is preferable that the post-coating-removal water-washing basin 49 includes an agitating unit that agitates the water in the basin. In this manner, it is possible to quickly remove the salts without fail. A method for regenerating a gas turbine blade according to the present embodiment will now be described.

[Method for Regenerating Gas Turbine Blade]

Figure 3:
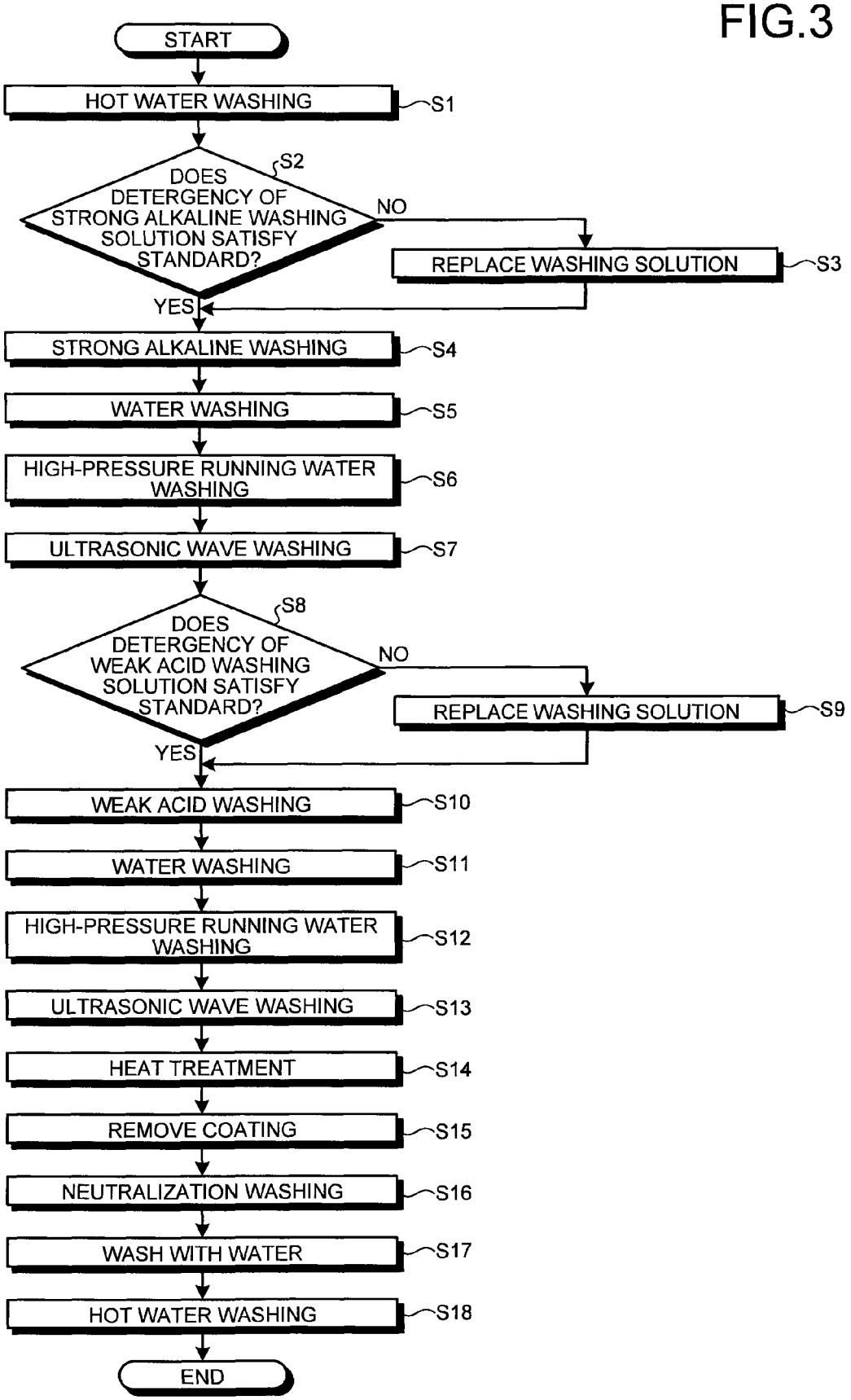
FIG. 3 is a flowchart of a procedure of a method for regenerating a gas turbine rotor blade according to the present embodiment.

FIG. 3 is a flowchart of a procedure of a method for regenerating a gas turbine rotor blade according to the present embodiment. An object to be regenerated in the method for regenerating the gas turbine blade according to the present embodiment is a gas turbine blade. In the present embodiment, an object to be regenerated is the gas turbine rotor blade 1 illustrated in FIG. 1. The gas turbine rotor blade 1, for example, is made of a Ni-based heat-resistant alloy as disclosed in Japanese Patent Publication No. 2556198.

To execute the method for regenerating the gas turbine rotor blade according to the present embodiment, for example, the gas turbine 1 is removed from a turbine disk, after an actual operation time from 5,000 hours to 40,000 hours has passed, and the gas turbine 1 is supported by the supporting unit 2 illustrated in FIG. 2. At this time, as described above, it is preferable to support the gas turbine rotor blade 1, with the longitudinal direction of the gas turbine rotor blade 1 substantially parallel to the vertical direction, the side of the fitting unit 1E of the turbine shaft being the lower side, and the side of the rotor blade tip being the upper side.

At Step S1, the gas turbine rotor blade 1 is immersed into hot water (step of hot water washing). By executing the step of hot water washing (Step S1), in the scales deposited on the gas turbine rotor blade 1 during the operation performed by the gas turbine, oil and water-soluble scales are removed to a certain degree. Accordingly, the strong alkaline washing solution more easily penetrates through the scales, thereby improving the effects of the strong alkaline washing. In the present embodiment, the temperature of the hot water at the step hot water washing, for example, is at equal to or more than 50 degrees centigrade and equal to or less than 80 degrees centigrade, and is preferably at approximately 65 degrees centigrade. It is preferable to perform the step of hot water washing before performing a step of strong alkaline washing, which will be described later.

In the present embodiment, before performing the step of strong alkaline washing (Step S4), which will be described later, whether the detergency of a strong alkaline washing solution satisfies the standard is inspected (step of inspecting a strong alkaline washing solution), at Step S2. If the detergency of a strong alkaline washing solution satisfies the standard (Yes at Step S2), the strong alkaline washing solution is used. If the detergency of a strong alkaline washing solution does not satisfy the standard (No at Step S2), the process proceeds to Step S3 at which the strong alkaline washing solution is replaced with that whose detergency satisfies the standard (step of replacing a strong alkaline washing solution). By performing the step of inspecting the strong alkaline washing solution (Step S2) and the step of replacing the strong alkaline washing solution (Step S3), at the next step of strong alkaline washing (Step S4), it is possible to wash the gas turbine rotor blade 1 with the strong alkaline washing solution with the detergency satisfying the standard, without fail. A method for determining whether the detergency of the strong alkaline washing solution satisfies the standard will be described later.

After hot water washing, at Step S4, the gas turbine rotor blade 1 supported by the supporting unit 2 is immersed into the strong alkaline washing solution, or preferably into the strong alkaline washing solution containing an oxidizing agent, stored in the strong alkaline washing basin 3 illustrated in FIG. 2. Thus, the gas turbine rotor blade 1 is washed with the strong alkaline washing solution (step of strong alkaline washing). By performing the step of strong alkaline washing (Step S4), it is possible to remove the scales soluble in the strong alkaline washing solution. Accordingly, at a step of heat treatment (Step S14), which will be described later, it is possible to prevent carbides in the grain boundaries of the gas turbine blade base material from disappearing from the outer surface of the gas turbine rotor blade 1, and from the inner wall surface to the deep region of the inner cooling medium passage 1P or the cooling medium passage branching unit 1B. Accordingly, it is possible to prevent changes in mechanical properties of the gas turbine rotor blade 1 (in particular, changes in mechanical properties at a high temperature).

At the step of strong alkaline washing (Step S4), it is preferable to perform washing while agitating the strong alkaline washing solution using an agitating unit such as bubbles or a propeller. By washing the gas turbine rotor blade 1 while agitating the solution, it is possible to prevent washing irregularities of the gas turbine rotor blade 1. It is particularly preferable to introduce bubbles as the agitating unit. The introduced bubbles can assist the washing with the strong alkaline washing solution. It is also possible to reduce the usage amount of the strong alkaline washing solution, thereby reducing the amount of washing liquid waste. The bubbles, for example, can be introduced into the strong alkaline washing solution in the strong alkaline washing container 4, through the bubble introduction tube 9 disposed directly above the bottom surface of the strong alkaline washing container 4 illustrated in FIG. 2.

At the step of strong alkaline washing (Step S4), it is preferable to pull out the gas turbine rotor blade 1 from the strong alkaline washing solution at every predetermined period of time (such as 30 minutes), after immersing the gas turbine rotor blade 1 into the strong alkaline washing solution, and then immersing the gas turbine rotor blade 1 into the strong alkaline washing solution again, after confirming that the strong alkaline washing solution is discharged from the inner cooling medium passage 12 and the cooling medium passage branching unit 1B of the gas turbine rotor blade 1. In this manner, it is possible to forcibly replace the strong alkaline washing solution in the inner cooling medium passage 1P of the gas turbine rotor blade 1.

In the present embodiment, at the step of strong alkaline washing (Step S4), the strong alkaline washing solution, or preferably, the strong alkaline washing solution containing an oxidizing agent is used. By using the strong alkaline washing solution, it is possible to remove the scale components soluble in the strong alkaline washing solution. By using the strong alkaline washing solution containing an oxidizing agent, a part of the scale components is oxidized and more easily dissolved into the strong alkaline washing solution, or the scales are more easily separated from the gas turbine rotor blade 1. Even a place where a polishing unit such as a brush cannot reach, like the inner cooling medium passage 12 and the cooling medium passage branching unit 1B of the rotor blade, can also be washed.

It is preferable that the strong alkaline washing solution oxidizes and dissolves $Cr_2O_3$. Because $Cr_2O_3$ is deposited on the rotor blade particularly solidly, in the components of the scales deposited on the gas turbine rotor blade 1, the scales are even more easily dissolved into the strong alkaline washing solution or the scales are even more easily separated from the gas turbine rotor blade 1 by oxidizing and dissolving $Cr_2O_3$ by using the strong alkaline washing solution that oxidizes and dissolves $Cr_2O_3$. It is also preferable that the strong alkaline washing solution is an aqueous solution. By using the aqueous solution instead of organic solvents, it is possible to wash the blade without releasing organic solvents into the atmosphere.

It is also preferable that the strong alkaline washing solution is an aqueous alkali metal hydroxide solution containing an alkali metal salt of permanganate. In this manner, because the composition of the strong alkaline washing solution is simple, it is possible to repeatedly use the strong alkaline washing solution while controlling the concentration. The aqueous alkali metal hydroxide solution containing an alkali metal salt of permanganate may be an aqueous sodium hydroxide solution containing sodium permanganate or potassium permanganate, and the like. It is more preferable to use an aqueous sodium hydroxide solution containing potassium permanganate as the strong alkaline washing solution. An additive agent besides the oxidizing agent may also be appropriately added to the strong alkaline washing solution.

When the aqueous alkali metal hydroxide solution containing an alkali metal salt of permanganate is used as the strong alkaline washing solution, at the step of inspecting the strong alkaline washing solution (Step S2) described above, it is preferable to determine whether the detergency of the strong alkaline washing solution satisfies the standard, by the self-potential of the strong alkaline washing solution. Because $Cr_2O_3$ that is one of the scale components is oxidized to $CrO_4^{2-}$ to be soluble in the strong alkaline washing solution, if the self-potential of the strong alkaline washing solution is a potential capable of oxidizing $Cr_2O_3$, it is possible to regard that the detergency of the strong alkaline washing solution is not degraded.

At the step of inspecting the strong alkaline washing solution (Step S2), the detergency of the strong alkaline washing solution can be easily inspected in a shorter period of time by measuring the redox potential of the strong alkaline washing solution, compared with when the concentrations of the alkali metal salt of permanganate and the alkali metal hydroxide are measured.

The self-potential of a potassium permanganate $KMnO_4$ solution around potential hydrogen from 13 to 14 is about 200 mVvsAg/AgCl_sat.KCl. Accordingly, it is possible to determine that the strong alkaline washing solution having a self-potential of about equal to or more than 200 mVvsAg/AgCl_sat.KCl has the detergency to oxidize and dissolve $Cr_2O_3$.

Accordingly, in the present embodiment, at the step of strong alkaline washing (Step S4), the strong alkaline washing solution having a self-potential of about equal to or more than 200 mVvsAg/AgCl_sat.KCl, is used.

At the step of inspecting the strong alkaline washing solution (Step S2) described above, the detergency is determined to satisfy the standard (Yes at Step S2), if the self-potential of the strong alkaline washing solution is equal to or more than about 200 mVvsAg/AgCl_sat.KCl. If the self-potential of the strong alkaline washing solution is less than about 200 mVvsAg/AgCl_sat.KCl, it is determined that the detergency does not satisfy the standard (No at Step S2). In this manner, at the step of strong alkaline washing (Step S4) of the present embodiment, it is possible to oxidize and dissolve $Cr_2O_3$ without fail by constantly using the strong alkaline washing solution with the detergency that can oxidize and dissolve $Cr_2O_3$. The oxidation and dissolution of $Cr_2O_3$ is accelerated by permanganic acid having a high oxidation power. The equilibrium potential of permanganic acid ($MnO_4^{2-}$: septivalent) and manganese dioxide ($MnO_2$: quadrivalent) is about 200 mVvsAg/AgCl_sat.KCl. Accordingly, if the self-potential is equal to or more than 200 mVvsAg/AgCl_sat.KCl, it is predicted that the oxidation and dissolution of $Cr_2O_3$ by permanganic acid will be carried out sufficiently.

At the step of strong alkaline washing (Step S4), it is preferable to keep the temperature of the strong alkaline washing solution at equal to or more than 70 degrees centigrade and equal to or less than 95 degrees centigrade, and preferably, at equal to or more than 72 degrees centigrade and equal to less than 95 degrees centigrade. By keeping the temperature of the strong alkaline washing solution at equal to or less than 95 degrees centigrade, it is possible to prevent excessive evaporation of the strong alkaline washing solution. If the temperature of the strong alkaline washing solution is less than 70 degrees centigrade, the time required to oxidize and dissolve $Cr_2O_3$ is 20% longer than the time required under the temperature of the strong alkaline washing solution equal to or more than 70 degrees centigrade. Accordingly, by keeping the temperature of the strong alkaline washing solution at equal to or more than 70 degrees centigrade, it is possible to wash the scales deposited on the gas turbine rotor blade 1 in a short period of time. By keeping the temperature of the strong alkaline washing solution at equal to or more than 72 degrees centigrade, it is possible to wash the scales in a shorter period of time, than when the temperature of the strong alkaline washing solution is kept at equal to or more than 70 degrees centigrade.

In particular, it is preferable to use the strong alkaline washing solution by keeping the temperature of the strong alkaline washing solution at equal to or more than 70 degrees centigrade and equal to or less than 80 degrees centigrade, and more preferably, at equal to or more than 72 degrees centigrade and equal to or less than 78 degrees centigrade. If the temperature of the strong alkaline washing solution is kept higher than 80 degrees centigrade, deterioration of the strong alkaline washing solution is accelerated, thereby rapidly degrading the detergency. Accordingly, by keeping the temperature of the strong alkaline washing solution at equal to or less than 80 degrees centigrade, or preferably at equal to or less than 78 degrees centigrade, the life of the strong alkaline washing solution is increased, compared with when the temperature of the strong alkaline washing solution is kept higher than 80 degrees centigrade. If the temperature of the strong alkaline washing solution is kept at equal to or less than 78 degrees centigrade, the life of the strong alkaline washing solution is further increased, compared with when the temperature of the strong alkaline washing solution is kept higher than 78 degrees centigrade. As a result, it is possible to repeatedly use the strong alkaline washing solution. In this manner, it is possible to reduce the waste of the strong alkaline washing solution.

At the step of strong alkaline washing (Step S4), for example, an aqueous solution in which the concentration of NaOH is from 10% by weight to 35% by weight, and the concentration of $KMnO_4$ is 3% by weight is used under the conditions in which the temperature of the washing solution is kept at equal to or more than 72 degrees centigrade and equal to or less than 78 degrees centigrade, and the immersion time is one hour. Under the conditions, a self-potential of the strong alkaline washing solution before washing is 364.4 mVvsAg/AgCl_sat.KCl, and the redox potential of the strong alkaline washing solution used for ten times to wash a test piece, is 297.8 mVvsAg/AgCl_sat.KCl. Accordingly, the both potentials are equal to or more than 200 mVvsAg/AgCl_sat.KCl. It has been proven that if the washing is performed under the conditions, even after the washing is repeated for ten times, the strong alkaline washing solution can maintain sufficient detergency.

In the present embodiment, after performing the step of strong alkaline washing (Step S4), the gas turbine rotor blade 1 is washed with water (step of water washing) at Step S5. By performing the step of water washing (Step S5), as described above, the gas turbine rotor blade 1 is cooled rapidly, thereby more easily separating the scales from the gas turbine rotor blade 1. It is also possible to remove the strong alkaline washing solution remaining on the gas turbine rotor blade 1. The step of water washing (Step S5) is a step at which water is used as the washing solution, and in the present embodiment, the gas turbine rotor blade 1 is immersed into water. At the step of water washing (Step S5), the gas turbine rotor blade 1 may also be washed with high-pressure running water or with ultrasonic waves through the medium of water.

When the gas turbine rotor blade 1 is immersed into water, it is preferable to repeat the processes of pulling out the gas turbine rotor blade 1 from the water during the immersion, discharging the water in the inner cooling medium passage 1P and the cooling medium passage branching unit 1B of the gas turbine rotor blade 1, and immersing the gas turbine rotor blade 1 into the water again, for several times. In this manner, it is possible to forcibly replace the water in the inner cooling medium passage 1P and the cooling medium passage branching unit 1B. It is also preferable to perform the step of water washing (Step S5) while agitating the water by an agitating unit.

After performing the step of water washing (Step S5), it is preferable to wash the outer surface of the gas turbine rotor blade 1 and the inner wall surface of the inner cooling medium passage 1P or the cooling medium passage branching unit 1B with high-pressure running water (step of high-pressure running water washing) at Step S6, and perform an ultrasonic wave washing in the ultrasonic wave washing basin storing therein water (step of ultrasonic wave washing) at Step S7. By performing the step of high-pressure running water washing and the step of ultrasonic wave washing, it is possible to remove more water-soluble scale components, the scales separated at the step of strong alkaline washing, and the strong alkaline washing solution.

In the present embodiment, before performing a step of weak acid washing at Step S10, which will be described later, whether the detergency of a weak acid washing solution satisfies the standard is inspected (step of inspecting a weak acid washing solution) at Step S8. If the detergency of a weak acid washing solution satisfies the standard (Yes at Step S8), the weak acid washing solution is used. If the detergency of a weak acid washing solution does not satisfy the standard (No at Step S8), the weak acid washing solution is replaced with that whose detergency satisfies the standard (Step S9, step of replacing weak acid washing solution). By performing the step of inspecting the weak acid washing solution and the step of replacing the weak acid washing solution, at the step of weak acid washing (Step S10) of the gas turbine rotor blade 1, which will be described later, it is possible to wash the gas turbine rotor blade 1 with the weak acid washing solution whose detergency satisfies the standard without fail. A method for determining whether the detergency of the weak acid washing solution satisfies the standard will be described later.

At Step S10, the gas turbine rotor blade 1 is immersed into the weak acid washing solution stored in the weak acid washing basin 16 (step of weak acid washing). By performing the step of weak acid washing, it is possible to remove the scales soluble in the weak acid washing solution, and at a step of heat treatment at Step S14, which will be described next, it is possible to prevent carbides in the grain boundaries of the gas turbine blade base material from disappearing from the outer surface of the gas turbine rotor blade 1, and from the inner wall surface to the deep region of the inner cooling medium passage 1P or the cooling medium passage branching unit 1B. Consequently, it is possible to prevent changes in mechanical properties of the gas turbine rotor blade 1, in particular, changes in mechanical properties at a high temperature.

At the step of weak acid washing (Step S10), it is preferable to wash the gas turbine rotor blade 1 while agitating the weak acid washing solution using an agitating unit such as bubbles or a propeller. By washing the gas turbine rotor blade 1 while agitating the weak acid washing solution, it is possible to prevent washing irregularities of the gas turbine rotor blade 1 from occurring. In particular, it is preferable to agitate the weak acid washing solution, by introducing bubbles into the weak acid washing solution. By introducing bubbles, it is possible to easily agitate the weak acid washing solution, and assist the washing with the strong alkaline washing solution. It is also possible to reduce the usage amount of the weak acid washing solution, thereby reducing the amount of washing liquid waste. The bubbles, for example, can be introduced into the weak acid washing solution in the weak acid solution washing container 17 through the bubble introduction tube 22 disposed directly above the bottom surface of the weak acid solution washing container 17 illustrated in FIG. 2.

It is preferable to temporarily pull out the gas turbine rotor blade 1 immersed into the weak acid washing solution, from the weak acid washing solution, at every predetermined period of time (such as from 30 minutes to one hour) after the immersion, and then immerse the gas turbine rotor blade 1 into the weak acid washing solution again, after confirming that the weak acid washing solution in the inner cooling medium passage 1P and the cooling medium passage branching unit 1B of the gas turbine rotor blade 1 is discharged. In this manner, it is possible to forcibly replace the weak acid washing solution in the inner cooling medium passage 1P and the cooling medium passage branching unit 1B of the gas turbine rotor blade 1.

It is preferable that the weak acid washing solution used at the step of weak acid washing (Step S10) is an aqueous solution. In this manner, by using the aqueous solution instead of organic solvents as the weak acid washing solution, it is possible to wash the gas turbine rotor blade 1, without releasing organic solvents into the atmosphere. The weak acid washing solution may be an aqueous solution of an organic or inorganic acid, such as an aqueous solution of appropriate concentration of citric acid and citrate, and an aqueous solution of acetic acid, formic acid, and sulfamic acid. The weak acid washing solution used in the present embodiment maybe a solution in which a plurality of types of acids are mixed as described above, and may contain various types of appropriate salts.

By washing the gas turbine rotor blade 1 with the weak acid washing solution, it is possible to remove components that cannot be removed by washing with the strong alkaline washing solution or water, but soluble in the weak acid washing solution, in the components of the scales deposited on the gas turbine rotor blade. Even at a place where a polishing unit such as a brush cannot reach, like the inner cooling medium passage 12 of the gas turbine rotor blade 1, the components soluble in the weak acid washing solution can be removed.

It is preferable to use an aqueous solution of citric acid and citric acid diammonium salt as the weak acid washing solution. In this manner, it is possible to easily dissolve and remove iron oxide in the scale components in particular, and at the next step of heat treatment, the gas turbine blade base material is less likely to deteriorate, compared with when the heat treatment is performed while the iron oxide is still being deposited. An additive agent besides acid may also be appropriately added to the weak acid washing solution.

When the aqueous solution of citric acid and citric acid diammonium salt is used as the weak acid washing solution, at the step of inspecting the weak acid washing solution (Step S8) described above, it is preferable to inspect the detergency of the acid washing solution, by measuring the absorbance of the weak acid washing solution at a wavelength from 390 nanometers to 410 nanometers, and preferably at a wavelength of 400 nanometers. In this manner, compared with a method for determining the detergency of the weak acid washing solution by analyzing the concentrations of citric acid and diammonium salt, it is possible to more easily inspect the detergency of the weak acid washing solution in a shorter period of time.

Figure 4:
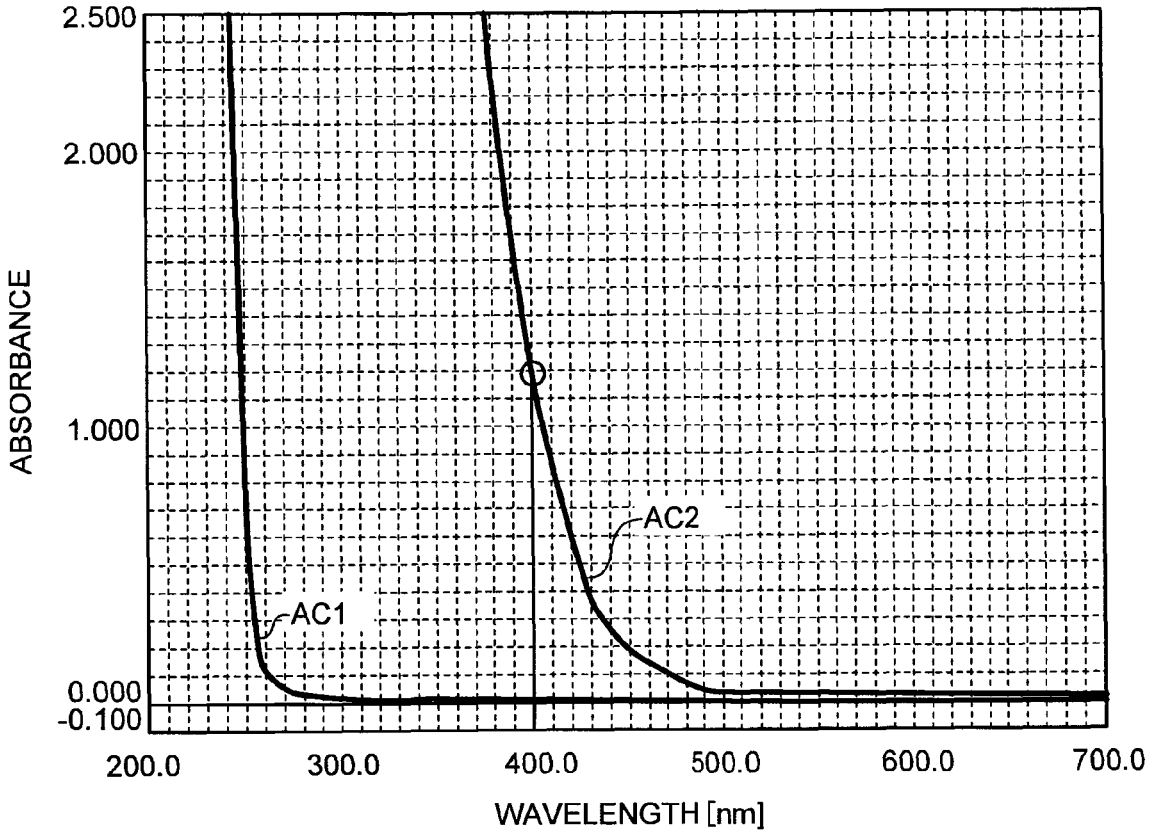
FIG. 4 is a schematic for explaining an example of absorbance of a weak acid washing solution, before and after the washing is performed with the weak acid washing solution.

FIG. 4 is a schematic for explaining an example of absorbance of a weak acid washing solution, before and after the washing is performed with the weak acid washing solution. In the example illustrated in FIG. 4, an aqueous solution of citric acid of 5% by weight and ammonium citrate dibasic of 5% by weight is used as the weak acid washing solution. In FIG. 4, an absorbance curve AC1 of the weak acid washing solution before being used for washing, and an absorbance curve AC2 of the weak acid washing solution after washing a test piece for ten times, are illustrated.

At the wavelength of 400 nanometers, the absorbance of the aqueous solution before being used is close to 0. The absorbance of the aqueous solution used for washing the test piece for ten times is in a range from equal to or more than 1.0 to equal to or less than 1.5. In this manner, if the aqueous solution of citric acid and citric acid diammonium salt is used as the weak acid washing solution, the absorbance of the weak acid washing solution at 400 nanometers may be used as an index of the detergency of the weak acid washing solution. If an aqueous solution of citric acid and citric acid diammonium salt having an absorbance larger than 1.5 at a wavelength of 400 nanometers is used, the immersion time needs to be increased. However, by increasing the immersion time, the grain boundaries of the matrix of the turbine blade and the like may be corroded by acid. Experiments have found that it is preferable to use the aqueous solution of citric acid and citric acid diammonium salt having an absorbance equal to or less than 1.5 at a wavelength of 400 nanometers to prevent corrosion by acid. To actually control the washing process, it is more preferable to use an aqueous solution of citric acid and citric acid diammonium salt having an absorbance equal to or less than 1.2 at a wavelength of 400 nanometers.

In the present embodiment, at the step of weak acid washing (Step S10), the weak acid washing solution having an absorbance equal to or more than 0 and equal to less than 1.5, and preferably, equal to or more than 0 and equal to or less than 1.2 at a wavelength of 400 nanometers is used. In this manner, at the step of weak acid washing (Step S10), it is possible to use the weak acid washing solution whose detergency satisfies the standard. Accordingly, it is possible to wash the gas turbine rotor blade 1 without fail.

At Step S8, the detergency of the weak acid washing solution is determined to satisfy the standard, if the absorbance of the weak acid washing solution is equal to or more than 0 and equal to or less than 1.5, and preferably, equal to or more than 0 and equal to or less than 1.2 at a wavelength of 400 nanometers (Yes at Step S8). At Step S8, the detergency of the weak acid washing solution is determined not to satisfy the standard, if the absorbance of the weak acid washing solution is larger than 1.5, and preferably, larger than 1.2 at a wavelength of 400 nanometers (No at Step S8).

At the step of weak acid washing (Step S10), it is preferable to keep the temperature of the weak acid washing solution at equal to or more than 75 degrees centigrade and equal to or less than 95 degrees centigrade, or preferably, at equal to or more than 80 degrees centigrade and equal to or less than 95 degrees centigrade, and even more preferably, at equal to or more than 90 degrees centigrade and equal to or less than 95 degrees centigrade. By keeping the temperature of the weak acid washing solution at equal to or less than 95 degrees centigrade, it is possible to prevent excessive evaporation of the weak acid washing solution. If the temperature of the weak acid washing solution is kept at equal to or more than 90 degrees centigrade, the solubility rate of the component soluble in the weak acid washing solution, in the components of the scales deposited on the gas turbine rotor blade 1 becomes faster than when the temperature of the weak acid washing solution is less than 90 degrees centigrade. Accordingly, it is possible to wash the gas turbine rotor blade 1 in a shorter period of time.

In the present embodiment, at the step of weak acid washing (Step S10), for example, an aqueous solution of citric acid of 5% by weight and ammonium citrate dibasic of 5% by weight is used as the weak acid washing solution under the conditions in which the temperature of the weak acid washing solution is kept at equal to or more than 90 degrees centigrade and equal to or less than 95 degrees centigrade, and the immersion time is from one hour to five hours. Compared with the strong alkaline washing solution, the deterioration degree of the weak acid washing solution at a high temperature is small. Accordingly, if the temperature of the weak acid washing solution is equal to or more than 90 degrees centigrade and equal to or less than 95 degrees centigrade, it is possible to repeatedly use the weak acid washing solution. In this manner, it is possible to reduce the waste of the weak acid washing solution.

After performing the step of weak acid washing (Step S10), it is preferable to wash the gas turbine rotor blade 1 with water (step of water washing after weak acid washing) at Step S11. By performing the step of water washing after weak acid washing (Step S11), the weak acid washing solution and water-soluble scale components can be washed away.

The water washing can be performed by immersing the gas turbine rotor blade water 1 into water. When the gas turbine rotor blade 1 is immersed into the water, processes of pulling out the gas turbine rotor blade 1 from the water during the immersion, discharging the water in the inner cooling medium passage 1P and the cooling medium passage branching unit 1B of the gas turbine rotor blade 1, and immersing the gas turbine rotor blade 1 into the water again may be repeated for several times. By performing the processes, it is possible to forcibly replace the water in the inner cooling medium passage 1P and the cooling medium passage branching unit 1B of the gas turbine rotor blade 1. It is also preferable to perform the step of water washing after weak acid washing solution (Step S11), while agitating the water by an agitating unit.

After performing the step of water washing after weak acid washing (Step S11), it is preferable to wash the outer wall surface and the inner wall surface of the gas turbine rotor blade 1 with high-pressure running water (step of high-pressure running water washing after weak acid washing) at Step S12, and perform an ultrasonic wave washing in the ultrasonic wave washing basin storing therein water (step of ultrasonic wave washing after weak acid washing), at Step S13. In this manner, it is possible to remove water-soluble scale components and the weak acid washing solution even further.

After washing the gas turbine rotor blade 1 at the step of ultrasonic wave washing after weak acid washing (Step S13), heat treatment is performed on the gas turbine rotor blade 1 (step of heat treatment) at Step S14. This heat treatment is a process of keeping the temperature at which a part of γ' layer deposited on the gas turbine blade base material is dissolved for a predetermined period of time, and then cooling the gas turbine rotor blade 1 slowly. In this manner, because the residual stress in the gas turbine rotor blade 1 can be removed, it is possible to reduce the stress corrosion cracking from occurring in the gas turbine blade 1, caused by the strong acid washing solution used to remove the coating on the surface of the gas turbine rotor blade 1 at Step S15. The structure of the gas turbine blade base material can also be recovered by the heat treatment at Step S14.

It is preferable that the heat treatment at Step S14 is a vacuum heat treatment. In this manner, it is possible to prevent oxygen in the air from reacting with gas turbine blade base material at a high temperature. The heat treatment at Step S14, for example, can be performed under the conditions in which the temperature is at equal to or more than 1000 degrees centigrade and equal to or less than 1200 degrees centigrade, the pressure is equal to or more than 0.05 torr and equal to or less than 0.7 torr (equal to or more than 0.05×133.322 pascal and equal to or less than 0.7×133.322 pascal), and the immersion time is equal to or more than 1.0 hour and equal to or less than 10 hours.

After the step of heat treatment at Step S14, the gas turbine rotor blade 1 after the heat treatment is immersed into a strong acid washing solution stored in the coating removal basin 37 illustrated in FIG. 2, and at least a part of the coating of the gas turbine rotor blade 1 is removed (step of removing coating) at Step S15. By washing the gas turbine rotor blade 1 with the strong acid washing solution, it is possible to remove at least a part of the coating (such as the CoNiCrAlY alloy coating) of the gas turbine rotor blade 1.

It is preferable to perform the step of removing coating (Step S15), for example, while agitating the strong acid washing solution using an agitating unit such as bubbles or a propeller. By removing the coating while agitating the strong acid washing solution, it is possible to prevent irregularities of coating removal of the gas turbine rotor blade 1. It is particularly preferable to use a method for introducing bubbles into the strong acid washing solution as the agitating unit. The introduced bubbles can assist the step of removing coating with the strong acid washing solution. It is also possible to reduce the usage amount of the strong acid washing solution, thereby reducing the amount of washing liquid waste. The bubbles, for example, may be introduced into the strong acid washing solution in the coating removal container 38, through the bubble introduction tube 46 disposed directly above the bottom surface of the coating removal container 38 illustrated in FIG. 2.

As the strong acid washing solution, a strong acid washing solution corresponding to the type of coating of the gas turbine rotor blade 1 may be used. In the present embodiment, hydrochloric acid is used. An additive agent may also be appropriately added to the strong alkaline washing solution. In the present embodiment, at the step of removing coating (Step S15), for example, hydrochloric acid prepared by adding concentrated hydrochloric acid of equal to or more than 10% by volume and equal to or less than 40% by volume, is used as the strong acid washing solution under the conditions in which the temperature of the strong acid washing solution is kept at equal to or more than 50 degrees centigrade and equal to or less than 80 degrees centigrade, and preferably, at equal to or more than 65 degrees centigrade and equal to or less than 70 degrees centigrade, and the immersion temperature is equal to or more than one hour and equal to or less than ten hours, and preferably five hours.

At Step S15, after washing the gas turbine rotor blade 1 with the strong acid washing solution, the strong acid washing solution remaining on the gas turbine rotor blade 1 is neutralized with an appropriate alkaline aqueous solution, for example, an aqueous sodium carbonate $Na_2CO_3$ solution of 5% by weight (step of neutralizing) at Step S16. The gas turbine rotor blade 1 is then washed with water (step of water washing after removal of the coating) at Step S17. By performing the step of neutralizing and the step of water washing after removal of the coating, it is possible to prevent acid components from remaining on the gas turbine rotor blade 1.

At the step of neutralizing and the step of water washing after removal of the coating, it is preferable to agitate the alkaline aqueous solution or the water by an agitating unit. After performing the step of water washing after removal of the coating (Step S17), the gas turbine rotor blade 1 is washed with hot water (step of hot water washing after removal of the coating) at Step S18. By performing the step of hot water washing after removal of the coating (Step S18), it is possible to dry the gas turbine rotor blade 1 speedily. At the step of hot water washing after removal of the coating (Step S18), for example, the gas turbine rotor blade 1 is immersed into hot water whose temperature is at equal to or more then 50 degrees centigrade and equal to or less than 80 degrees centigrade, and preferably, at 65 degrees centigrade.

In the present embodiment, the gas turbine blade after being operated is washed by sequentially being: immersed into a strong alkaline washing solution, or preferably, a strong alkaline washing solution containing an oxidizing agent; washed with water; washed by being immersed into a weak acid washing solution; and being subjected to heat treatment. The gas turbine blade after the heat treatment is then immersed into a strong acid washing solution, whereby the coating formed on the surface of the gas turbine blade is removed. In this manner, it is possible to remove the scales deposited on the outer surface of the gas turbine blade and the inner surface of the inner cooling passage and the like before the heat treatment is performed. As a result, it is possible to prevent carbides in the grain boundaries of the gas turbine blade base material from disappearing from the outer surface of the gas turbine rotor blade 1, and from the inner wall surface to the deep region of the inner cooling medium passage and the like. Accordingly, it is possible to prevent changes in mechanical properties of the gas turbine rotor blade, in particular, changes in mechanical properties at a high temperature. Because appropriate temperature conditions of the strong alkaline washing solution and the weak acid washing solution are found, it is possible to repeatedly use the strong alkaline washing solution and the weak acid washing solution

INDUSTRIAL APPLICABILITY

As described above, the method for regenerating the gas turbine blade and the gas turbine blade regenerating apparatus according to the present embodiment can advantageously regenerate the gas turbine blade. More specifically, the method for regenerating the gas turbine blade and the gas turbine blade regenerating apparatus are suitable for reducing changes in mechanical characteristics of the gas turbine blade base material.

The invention claimed is:

1. A method for regenerating a gas turbine blade, the method comprising:

a step of hot water washing at which the gas turbine blade after being operated is immersed into hot water;

a step of inspecting a strong alkaline washing solution at which whether or not a detergency of the strong alkaline washing solution satisfies a standard is determined;

a step of strong alkaline washing at which the gas turbine blade after the step of hot water washing is washed by being immersed into the strong alkaline washing solution after the step of inspecting the strong alkaline washing solution;

a step of first water washing at which the gas turbine blade after being washed with the strong alkaline washing solution is washed with water;

a step of inspecting a weak acid washing solution at which whether or not a detergency of the weak acid washing solution satisfies a standard is determined;

a step of weak acid washing at which the gas turbine blade after the step of first water washing is washed by being immersed into the weak acid washing solution after the step of inspecting the weak acid washing solution;

a step of second water washing at which the gas turbine blade after the step of the weak acid washing is washed with water;

a step of heat treatment at which the gas turbine blade after the step of second water washing is subjected to heat treatment; and a step of removing coating at which at least a part of coating formed on a surface of the gas turbine blade is removed by immersing the gas turbine blade after the heat treatment into a strong acid washing solution.

2. The method for regenerating a gas turbine blade according to claim 1, wherein the strong alkaline washing solution is an aqueous alkali metal hydroxide solution containing an alkali metal salt of permanganate.

3. The method for regenerating a gas turbine blade according to claim 2, wherein the aqueous alkali metal hydroxide solution is an aqueous sodium hydroxide solution containing potassium permanganate.

4. The method for regenerating a gas turbine blade according to claim 2, wherein at the step of strong alkaline washing, the aqueous alkali metal hydroxide solution having a self-potential equal to or more than 200 mVvsAg/AgCl_sat.KCl is used.

5. The method for regenerating a gas turbine blade according to claim 1, wherein at the step of strong alkaline washing, the gas turbine blade is washed by keeping a temperature of the strong alkaline washing solution at equal to or more than 70 degrees centigrade and equal to or less than 95 degrees centigrade.

6. The method for regenerating a gas turbine blade according to claim 1, wherein the weak acid washing solution is an aqueous weak acid solution of citric acid and citric acid diammonium salt.

7. The method for regenerating a gas turbine blade according to claim 6, wherein the aqueous weak acid solution used at the step of weak acid washing has an absorbance of equal to or more than 0 and equal to or less than 1.5 at a wavelength of 400 nanometers.

8. The method for regenerating a gas turbine blade according to claim 6, wherein at the step of weak acid washing, the gas turbine blade is washed by keeping a temperature of the weak acid washing solution at equal to or more than 80 degrees centigrade and equal to or less than 95 degrees centigrade.

9. The method for regenerating a gas turbine blade according to claim 1, wherein the strong acid washing solution is hydrochloric acid.

10. The method for regenerating a gas turbine blade according to claim 1, wherein the step of water washing includes a normal running water washing, a high-pressure running water washing and an ultrasonic wave washing.

11. The method for regenerating a gas turbine blade according to claim 1, wherein:

the gas turbine blade includes scales deposited on an inner wall surface of a cooling medium passage inside the gas turbine blade prior to the step of hot water washing; and the scales are removed as a result of the steps after the step of hot water washing, at least just prior to the step of heat treatment.

12. The method for regenerating a gas turbine blade according to claim 1, wherein:

the scales include at least one of $Fe_2O_3$, $Na_2SO_4$ or $ZnSO_4$.

13. A method for regenerating a gas turbine blade, the method comprising:

a step of strong alkaline washing at which a gas turbine blade after being operated washed by being immersed into a strong alkaline washing solution;

a step of first water washing at which the gas turbine blade after being washed with the strong alkaline washing solution is washed with water;

a step of weak acid washing at which the gas turbine blade after the step of first water washing is washed by being immersed into the weak acid washing solution;

a step of second water washing at which the gas turbine blade after the step of the weak acid washing is washed with water;

a step of heat treatment at which the gas turbine blade after the step of second water washing is subjected to heat treatment; and a step of removing coating at which at least a part of coating formed on a surface of the gas turbine blade is removed by immersing the gas turbine blade after the heat treatment into a strong acid washing solution.

14. The method for regenerating a gas turbine blade according to claim 13, wherein the strong alkaline washing solution is an aqueous alkali metal hydroxide solution containing an alkali metal salt of permanganate.

15. The method for regenerating a gas turbine blade according to claim 1, further comprising, after immersing the gas turbine blade into a strong acid washing solution, using the gas turbine blade in a gas turbine engine where the gas turbine blade is subjected to heat generated by combustion in the engine.

16. The method for regenerating a gas turbine blade according to claim 13, further comprising, after immersing the gas turbine blade into a strong acid washing solution, using the gas turbine blade in a gas turbine engine where the gas turbine blade is subjected to heat generated by combustion in the engine.

* * * * *